United States Patent [19]

Stine

[11] 3,961,713

[45] June 8, 1976

[54] SINGLE LINE DAVIT

[75] Inventor: Joe C. Stine, Houston, Tex.

[73] Assignee: Houston Systems, Inc., Houston, Tex.

[22] Filed: June 28, 1974

[21] Appl. No.: 483,925

[52] U.S. Cl. ..... 212/58 R; 212/3; 212/66; 254/186 R

[51] Int. Cl.[2] ..... B66C 23/06

[58] Field of Search..... 254/145, 150 R, 150 FH, 254/135 R, 186 R; 212/3, 35 R, 35 HC, 58 R, 59 R, 66, 67, 68, 69; 214/130 R

[56] References Cited

UNITED STATES PATENTS

| | | | |
|---|---|---|---|
| 727,849 | 5/1903 | Schmaltz | 212/8 R |
| 2,020,803 | 11/1935 | Sauer | 212/66 |
| 2,313,084 | 3/1943 | Manly | 212/68 |
| 2,601,927 | 7/1952 | Frenzel | 212/35 R |
| 2,631,737 | 3/1953 | Cullen | 212/67 |
| 3,250,401 | 5/1966 | Davidson | 212/69 |
| 3,690,387 | 9/1972 | Dixon | 212/35 R |
| 3,726,801 | 4/1973 | Sterner et al. | 254/150 FH |

*Primary Examiner*—Robert J. Spar
*Assistant Examiner*—Lawrence J. Oresky
*Attorney, Agent, or Firm*—Pravel & Wilson

[57] ABSTRACT

A new and improved davit utilizing a single line which is mounted onto a rotating drum supported by opposing spaced frame members, which frame members are mounted onto a rotatable base, which rotatable base is rotated by a motordriven pinion in engagement with a stationary, circular rack mounted about the rotatable base.

5 Claims, 4 Drawing Figures

SINGLE LINE DAVIT

BACKGROUND OF THE INVENTION

The field of this invention relates to crane structures for raising and/or lowering extremely heavy pipe lengths.

The tremendous increase in offshore oil well completions has effected the need for underwater pipelines for carrying the oil to shore or to offshore central storage facilities. Underwater pipelines for carrying oil or other fluids are generally formed with extremely large pipe lengths which may be, for example, six feet in diameter, which pipe lengths are weight-coated with concrete or other material. These underwater pipelines are laid from pipeline barges or other vessels which use various types of cranes to move the pipe lengths from storage areas on the barges to the pipe joining stations.

A davit is a type of crane which has been used on pipe laying barges and includes a boom assembly and a separate hydraulic ram for controlling the pivotal movement of the boom assembly. One such davit utilized a sheave system which included 8 sheaves to reduce the load sufficient so that a winch system could effectively operate to raise or lower the pipe lengths. One of the disadvantages of this type of davit was that the line tended to tangle in the elaborate sheave system, particularly when the davit was not loaded.

Another type of davit used a single chain line for raising and lowering such pipe lengths. However, the chain line type of davit required a separate storage bin for receiving the chain since the chain could not be wound about a drum.

SUMMARY OF THE INVENTION

This invention provides a new and improved davit utilizing a single line for raising and lowering extremely heavy pipe lengths or the like wherein the davit includes a rotating base having mounted thereon a pedestal which supports a davit-supporting frame. The davit-supporting frame includes opposing frame members which are spaced from each other and extend upwardly at approximately the center of the pedestal. A boom assembly is pivotally mounted onto the opposing frame members and a hydraulic ram assembly is pivotally connected between the davit-supporting frame and the boom assembly for moving the boom assembly in a vertical plane. A winch assembly is mounted internally of the opposing frame members, which winch assembly includes a rotating drum having mounted thereon a single line which extends outwardly through the boom assembly for raising, lowering and otherwise supporting pipe lengths or the like.

The winch assembly of the preferred embodiment of this invention includes a drum mounted for rotation between the opposing frame members. The drum has positioned therein a drum shaft and a gear drive assembly is mounted onto the opposing side frame members in operative engagement with the drum shaft for controlling the rotation of the drum in winding and unwinding the single davit line which extends outwardly from the drum, through the boom assembly for supporting a pipe length for raising and lowering same.

BRIEF DESCRIPTION OF THE DRAWINGS

FIG. 3 is a sectional view taken along line 3—3 of FIG. 1 illustrating the mounting of the davit base for rotational movement with respect to the deck of a ship or the like; and FIG. 4 is a partly sectional view of the winch assembly which includes a centrally mounted rotating drum.

DESCRIPTION OF THE PREFERRED EMBODIMENT

Figure 1:
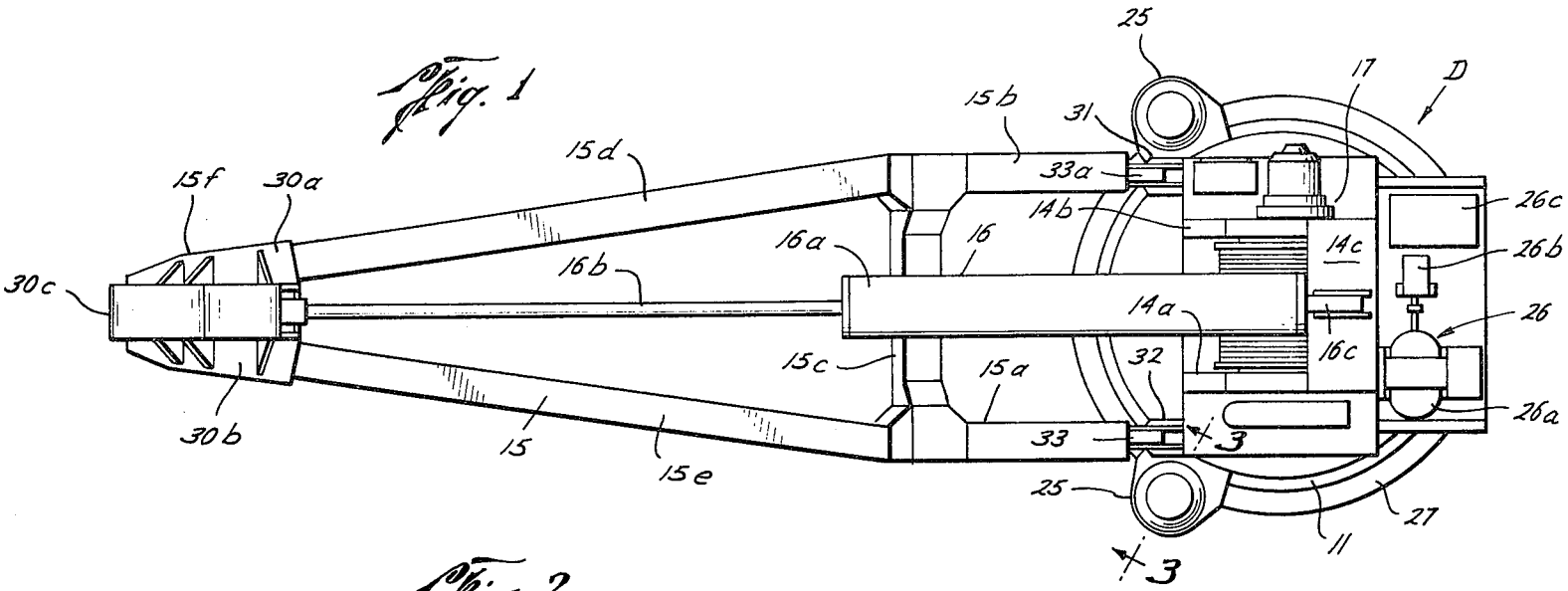
FIG. 1 is a top view of the single line davit of the preferred embodiment of this invention.
Figure 2:
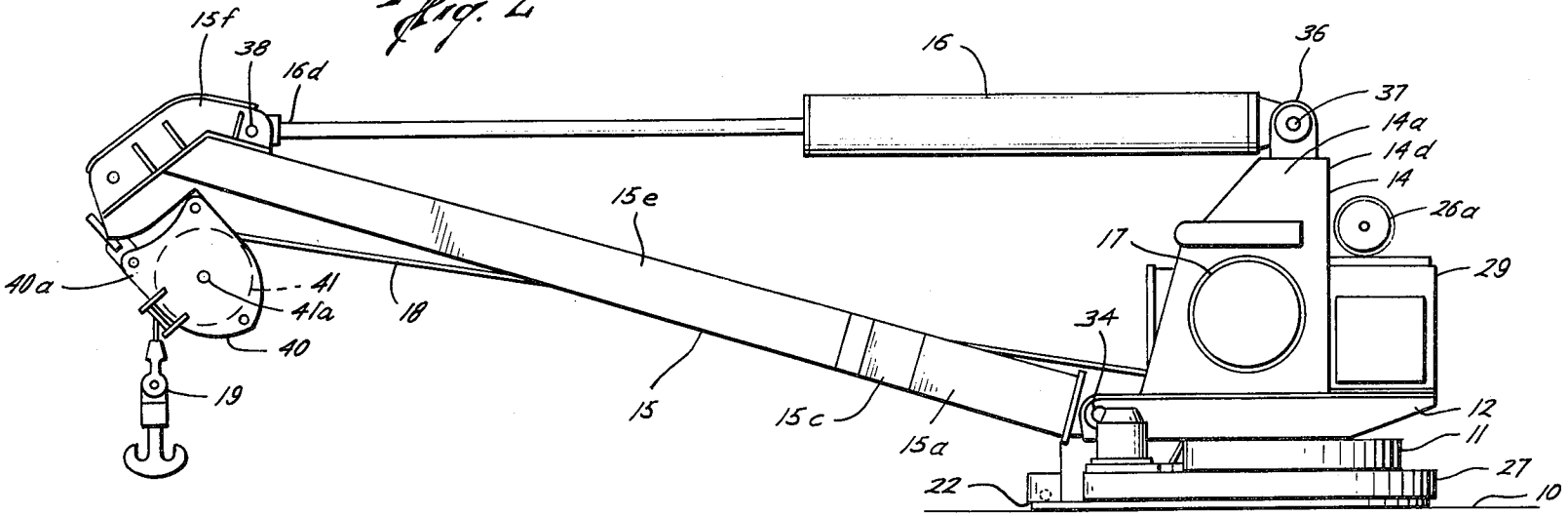
FIG. 2 is a side view of the single line davit of FIG. 1.

Referring to the drawings, the letter D designates the single line davit of the preferred embodiment of this invention for raising and lowering extremely heavy pipe lengths or the like. The single line davit D is mounted onto the deck of a barge, ship or other floating vessel and is used particularly in the laying of underwater pipelines in accordance with the preferred embodiment of this invention. Although the vessel or ship is not illustrated in the drawings, the line 10 is used to designate the deck of the barge, ship or other floating vessel on which the davit D is mounted.

The davit D includes a base 11 and pedestal 12 mounted for rotation on the vessel deck 10. The pedestal 12 supports a davit frame generally designated as 14 and the davit frame 14 supports a boom assembly 15 and hydraulic ram 16. The boom assembly 15 cooperates with a winch assembly generally designated as 17 for supporting a single lift line 18 having mounted thereon any suitable hook means 19.

The base 11 includes a circular platform 11*a* which is mounted by any suitable means for rotation onto the vessel deck 10. The circular platform 11*a* basically is one or more circular, heavy metal plates which are mounted for rotation by suitable means onto the vessel deck 10. An annular mounting rim 11*b* is mounted onto the outside, circular wall 11*c* of the circular platform 11*a* by any suitable means such as welding. An annular, inner race member 20*a* is mounted onto the underside of the annular mounting member 11*b* by means of bolts 21. The inner race 20*a* is also annular in configuration and thus extends about the entire circular platform mounting rim 11*b* and the bolt 21 in FIG. 3 actually represents a series of circumferentially spaced bolts mounted at equal distances about the inner race 20*a* and mounting rim 11*b* for attaching the inner race 20*a* to the mounting rim 11*b*.

An annular rack 22 is permanently attached to the vessel deck 10 by any suitable means. The annular rack 22 has an outside wall 22*a* formed with gear teeth throughout its circumference for the purpose of providing a circular rack gear. Inside annular rack wall 22*b* has a diameter only slightly greater than the outside diameter of the inner race member 20*a* such that the annular rack 22 is positioned concentrically outwardly, but closely adjacent to the inner race 20*a*, which inner race is attached to the circular platform 11*a* as previously described.

The inner race 20*a* includes a series of semi-cylindrical recesses 20*b* which align with a series of semi-cylindrical recesses 22*c* in the inner annular rack wall 22*b* for receiving ball bearings 23. The ball bearings 23 are thus mounted in a series of circumferentially spaced recesses formed by semi-cylindrically recessed portions 20*b* and 22*c* to provide a bearing means generally designated by the number 24 for mounting the circular platform 11*a* and the pedestal 12 for rotation with respect to the vessel deck 10. In addition, the bearing means 24 provides a means for circumferentially distributing the weight of pipe lengths or the like suspended from the single lift line 18, regardless of the particular rotational position of the circular platform 11*a*. Thus, in any rotational position, the bearing means 24 is capable of distributing or transferring the stress and strain due to the lifting of a heavy pipe length or the like to the annular rack 22 and thus to the vessel deck 10.

Figures 3, 4:
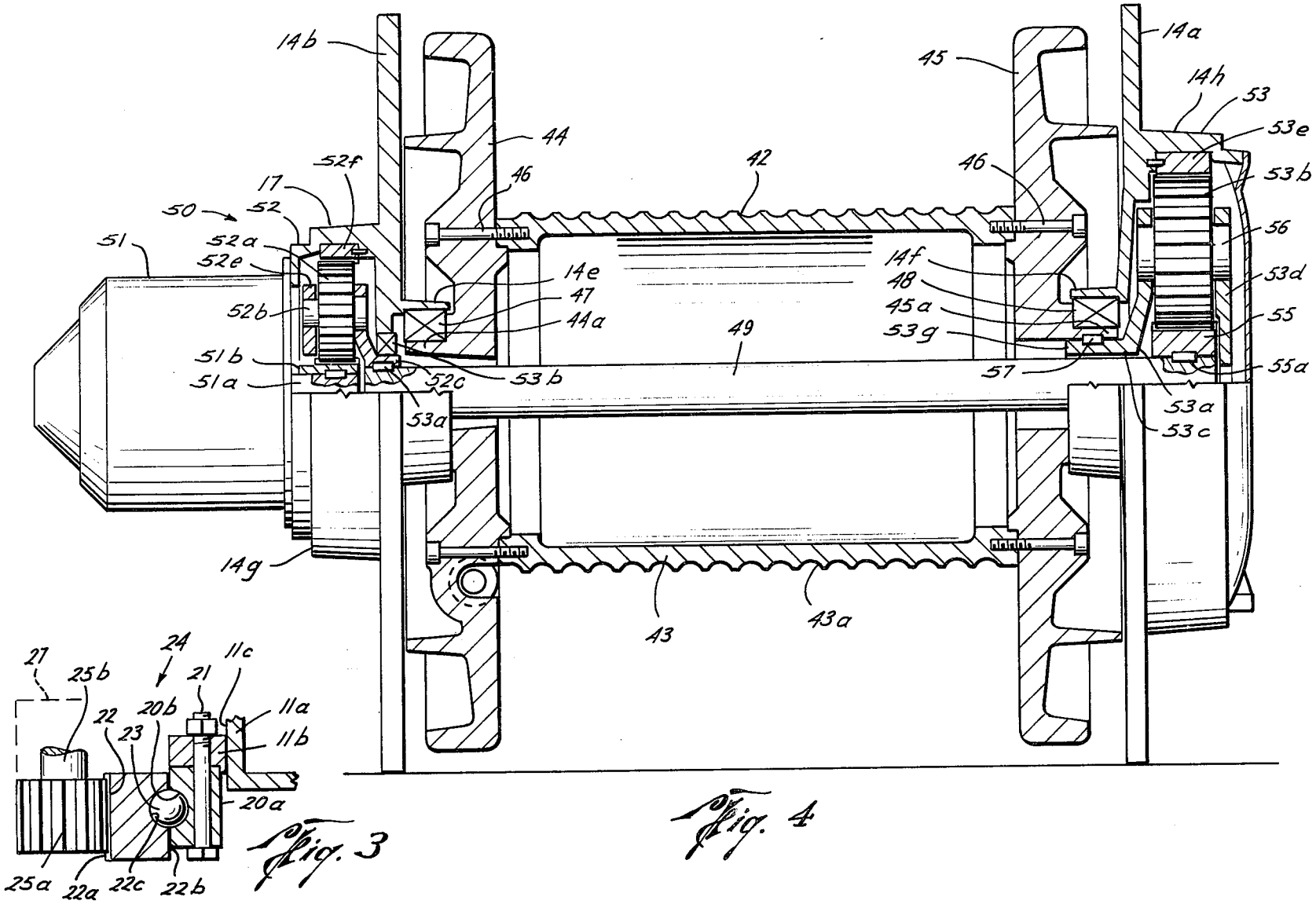

Two circumferentially spaced hydraulic motor units 25 are mounted onto the circular platform 11*a* for operatively engaging the annular rack 22 through a drive pinion 25*a*, which is driven through driveshaft 25*b* of the hydraulic motor units 25. Hydraulic fluid under pressure is supplied to the hydraulic motors 25 through the pressure supply means generally designated as 26. In the preferred embodiment of the invention illustrated in the drawings, the pressure supply means 26 includes a motor 26*a* and pump 26*b* which is connected with a hydraulic reservoir 26*c* for providing the necessary hydraulic fluid under pressure to drive the hydraulic motor units 25 and other hydraulic equipment to be later described. Of course, any suitable source of hydraulic power may be utilized in place of the pressure supply means 26 described herein. It is noted that the driveshaft 25*b* actually extends downwardly from the hydraulic unit 25 and that the drive pinion 25*a* of the hydraulic units 25 includes a gear tooth structure which meshes with the circumferential rack 22. An annular cover member 27 illustrated schematically in FIG. 3 is mounted over a portion of the rotating base 11 and extends outwardly over the annular rack 22.

The davit frame 14 includes opposing side frame members 14*a* and 14*b* which are mounted onto the pedestal 12 and extend upward therefrom. The side frame members 14*a* and 14*b* are positioned at approximately the center of the rotating base 11 and serve to support the winch assembly 17, which is mounted substantially at or over the center of the rotating base 11. The side frame members 14*a* and 14*b* are joined by a top frame member 14*c* and a rear panel 14*d*. The base 12 supports a box-like structure 29 which is also attached to the rear frame panel 14*d* for supporting the motor 26*a*, pump 26*b* and reservoir 26*c* for the hydraulic power.

The boom assembly 15 includes parallel beam portions 15*a* and 15*b* which are joined by a transverse support beam 15*c*. Converging beam portions or members 15*d* and 15*e* are welded onto the transverse beam member 15*c* and converge at nose 15*f*. The nose 15*f* includes suitable structure for receiving and supporting the converging beam portions 15*d* and 15*e*. The nose 15*f* includes a beam receiving structure 30*a* for receiving the beam 15*d* and a similar beam receiving structure 30*b* for receiving the beam 15*e*. These structures are joined by a central connecting structure 30*c*. These structures 30*a*, 30*b* and 30*c* are suitably designed in a well known manner to house the beam portions 15*d* and 15*e* and to support the entire boom assembly 15.

The boom assembly 15 is pivotally mounted onto the pedestal 12 for pivotal movement in substantially a vertical direction. The pedestal 12 includes opposing pairs 31 and 32 of spaced lug members which receive lugs 33*a* and 33*b* attached to the parallel boom beam members 15*b* and 15*a*, respectively. The lugs 33*a* and 33*b* are attached to the pairs of lugs 31 and 32, respectively, by means of suitable pins 34.

The position of the entire boom assembly 15 is controlled by the hydraulic ram 16. The hydraulic ram 16 includes a cylinder 16*a* having mounted therein in a well known manner a piston and rod assembly 16*b*. The hydraulic ram 16 is double acting in a well known manner such that hydraulic fluid under pressure may be applied to either end of the cylinder 16*a* in order to move the piston and rod assembly 16*b* between extended and retracted positions. The cylinder 16 includes a mounting lug 16*c* which is joined to a pair 36 of lugs which extend upwardly from the top frame member 14*c*. The cylinder lug 16*c* is attached to the pair 36 of lugs by a suitable pin 37. The piston and rod assembly 16*b* is mounted for pivotal movement of the nose 15*f* of the boom assembly 15. The piston and rod assembly 16*b* may be defined as including a rod end portion 16*d* which is attached to the boom nose 15*f* by pin 38 for pivotal movement with respect to the boom nose. Thus, the hydraulic ram 16 is mounted for pivotal movement with respect to the davit frame 14 and the boom assembly 15. Further, the ram controls the rotation of the boom assembly 15 and is capable of moving the boom assembly between up and down positions by retracting and extending, respectively, the piston and rod assembly 16*b* mounted in the hydrauilc cylinder 16*a*.

The boom nose 15*f* has mounted thereon a block 40 which includes side members such as 40*a* which mount for rotation a directional sheave 41. The sheave 41 is mounted for rotation by any suitable means such as the pin 41*a* which is journaled into the block side members such as 40*a*. The single line 18 is mounted over the sheave 41.

The winch assembly 17 is mounted between the opposing side frame members 14*a* and 14*b* for winding and unwinding the single line 18 for raising and lowering such extremely heavy objects as large pipe lengths. The winch assembly is internally housed within the opposing side frame member 14*a* and 14*b* for controlling the movement of the single line 18 from a point located substantially at the center of the entire davit D. The locating of the winch assembly 17 substantially at the center of the rotating base 11 eliminates unnecessary stress on the rotating base 11 and thus on the bearing means 24. The winch assembly 17 basically includes the winch drum 42 which is mounted onto and between the opposing side frame members 14*a* and 14*b* for rotation. The winch drum 42 includes a hollow, cylindrical drum portion 43. The drum portion 43 is circumferentially grooved on outside wall 43*a* for receiving and firmly holding the single line 18 during winding and unwinding operations. The drum portion 43 is hollow and has a cylindrical inside wall 43*b*. The drum 42 further includes drum side members 44 and 45 which are bolted into the ends of the drum portion 43 by bolts such as 46.

The side frame member 14*b* includes a mounting rim portion 14*e* which extends inwardly and may be formed integrally with the side frame member 14*b*. The drum side member 44 includes an annular hub section 44*a* which is positioned concentrically within the side frame member mounting rim portion 14*e* and a bearing 47 is mounted between the hub portion 44*a* and the mounting rim 14*e* to mount the entire drum 42 for rotational movement.

Similarly, the side frame member 14*a* includes a mounting rim portion 14*f* formed integrally therewith and extending inwardly to receive hub portion 45*a* of the drum side 45. And, a suitable bearing 48 is mounted onto the hub portion 45*a* and the mounting rim 14*f* such that the drum side 45 and thus the entire drum 42 is mounted for rotational movement with respect to the side frame member 14*a*. The utilization of the hub structures 44*a* and 45*a* on the drum sides 44 and 45, respectively, serve to distribute the stress transferred from the lift line 18 onto the side frame members 14*a* and 14*b*.

A winch drive generally designated by the number 50 is mounted onto the frame sides 14*a* and 14*b* in operative engagement with the drum 42 for controlling the rotation of the drum, particularly under the high stress conditions occurring when the single line 18 is supporting a heavy load. The winch drive 50 includes a hydraulic motor unit 51 mounted onto the side frame member 14*b* in operative engagement with a first gear means 52. The first gear means 52 is also mounted onto the side frame member 14*b* and operably engages a drum shaft 49 which extends through the drum 42 and through both side side frame members 14*a* and 14*b*. A second gear means 53 is mounted onto the side frame member 14*a* in operative engagement with the drum shaft 49 and with the drum side 45 for transferring power from the drum shaft 49 to the drum 42. The winch drive 50 is a power train which is serially to connected gear means 52 and 53 to provide sufficient mechanical advantage to control movement of the extremely heavy loads carried by the single davit line 18.

The hydraulic motor 51, in the preferred embodiment of the invention, is a Roto-versal, reversible fluid motor, model 1200, manufactured by Lantec Industries, Ltd. of Langley, B. C. Canada. The fluid motor 51 is mounted onto an external, annular housing portion 14*g* of the side frame member 14*b* in a suitable manner. The fluid motor 51 includes a drive shaft 51*a* which has mounted thereon a central pinion gear 51*b*. The central pinion gear 51*b* engages three, circumferentially spaced planetary-type pinion gears 52*a* of the first gear means 52. The three planetary-type pinion gears 52*a* are mounted for rotation onto a yoke 52*b*; the yoke 52*b* includes a hub portion 52*c* which is mounted onto the drum shaft 49 by key 53*a*. The yoke hub 52*c* is also mounted for rotation in the frame side member 14*b* by a bearing 53*b*. In this manner, the yoke 52*b* mounts the drum shaft 49 for rotation with respect to the frame side member 14*b* and, the yoke is driven by the central drive pinion 51*b*. The three pinion gears 52*a* are mounted for rotation on the yoke 52*a* by shafts or pins 52*d*, which are supported by yoke support caps 52*e*. The first gear means 52 further includes an annular planetary-type rack 52*f* which is mounted within the annular frame housing portion 14*g* and operatively engages each of the three circumferentially spaced gears 52*a*. Therefore, the first gear means 52 is a planetary-type gear for transferring power and providing a gear reduction between the motor drive shaft 51*a* and the drum shaft 49.

The second gear means 53 transfers power from the drum shaft 49 to the drum 42 and is also a planetary-type gear means. The drum shaft 49 has mounted thereon a drive pinion gear 55 by any suitable means such as a key 55*a*. The second gear means 53 includes a yoke 53*a* which has mounted thereon three, circumferentially spaced planetary-type pinion gears 53*b*. The yoke 53*a* is very similar to the yoke 52*b* of the first gear means 52 and includes a yoke hub 53*c*. Yoke support plate 53*d* and pins or shafts such as 56 mounts the circumferentially spaced gears 53*b* for rotation. An annular, outer gear rack 53*e* is mounted into a side frame member gear housing portion 14*h* to complete the planetary gear means 53. The yoke hub 53*c* is mounted concentrically within the drum side hub 45*a* over the shaft 49. The yoke hub 53*c* is mounted for rotation with the drum side 45 by means of a key 57. In this manner, power is transferred from the drum shaft 49 to the drum side 45, and thus to the drum 42, through the second planetary gear means 53 and the yoke 53*a*, which serves to mount the circumferential gears 53*b* of the planetary gear means.

Thus the winch drive 50, which receives fluid power from the fluid pressure supply means 26, drives the central pinion 51*b* mounted on the motor drive shaft 51*a*. Rotation of the central pinion 51*b* causes rotation of the planetary gear means 52 which drives the drum shaft 49. The drum shaft 49 transfers power through the pinion 55 to the second planetary gear means 53. And, the second planetary gear means 53 includes the yoke 53*a* which is connected at hub portion 53*c* to the drum side member 45 for transferring power from the drum shaft 49 to the drum 42.

In operation and use of the single line davit D of the preferred embodiment of this invention, the rotatable base 11 is mounted onto a vessel deck by any suitable means. Generally, the davit D of the preferred embodiment of this invention will be mounted such that the boom assembly 15 extends over the sides of the vessel for raising extremely heavy pipe lengths or other such loads upwardly onto the vessel deck 10. Suitable control means are mounted with the davit D for controlling the application of fluid pressure from the pressure supply means 26 to the hydraulic motor units 25 for rotating the entire davit D, to the double acting hydraulic ram 16 for controlling the vertical position of the boom 15 and to the reversible hydraulic motor 51 for winding and unwinding the single line 18. In this manner, the position of the boom as well as the position and rate of travel of the single line 18 can be controlled as desired, thus giving the entire davit D flexibility in its lifting and lowering operations. The pipe lengths which are handled by the davit of the preferred embodiment of this invention may be extremely large such as 5½ to 6 feet in diameter and may even be concrete coated on the outside and are thus tremendously heavy.

The single line davit D of this invention is particularly adapted to distribute the tremendous stresses exerted on the davit by heavy loads such as weighted pipe lengths through the circumferential bearing means 24 which mounts the rotating base 11 for rotation. The hydraulic motor units 25 are mounted onto the rotating base 11 and extend outwardly therefrom and include drive pinions 25*a* which are positioned on the outside of the annular rack 22 for the purpose of rotating the base 11, pedestal 12 and the boom mounted therewith. The position of the hydraulic units 25 at the outermost point with respect to base 11 provide a maximum mechanical advantage for the rotation of the davit D. The central mounting of the drum 42 eliminates unnecessary moments found in prior art cranes and serves to centralize the stresses over the rotating base 11.

The foregoing disclosure and description of the invention are illustrative and explanatory thereof, and various changes in the size, shape, and materials as well as in the details of the illustrated construction may be made without departing from the spirit of the invention.

I claim:

1. A new and improved single line davit for raising and lowering extremely heavy pipe lengths or the like, comprising:

a rotatable base adapted for mounting onto the deck of a floating vessel or the like, said base being mounted for rotation with respect to said deck;

a pedestal mounted onto said rotatable base for rotation therewith;

a davit-supporting frame mounted onto said pedestal for rotation therewith, said davit supporting frame including opposing, spaced frame members extending upwardly at approximately the center of said pedestal;

a boom assembly pivotally mounted at said opposing frame members and a hydraulic ram assembly pivotally connected between said davit-supporting frame and said boom assembly for moving said boom assembly;

a winch assembly mounted internally of said opposing frame members, said winch assembly including a rotating drum located at substantially the center of said rotatable base and having mounted thereon a single line which extends outwardly through said boom assembly, for raising, lowering or otherwise supporting pipe lengths or the like and a winch drive;

said winch drive including:

drum mounting means mounting said drum for rotation at substantially the center of said rotatable base;

said drum having a drum shaft extending through said drum and through said opposing frame members;

a first planetary gear drive mounted on one of said opposing frame members in operative engagement with said drum shaft, said first gear drive being driven by a motor means mounted on said one opposing frame members; and a second planetary gear drive being mounted with said other opposing frame member in operative engagement with said drum shaft and said drum for rotating said drum in response to rotation of said shaft;

a substantially circular rack adapted for mounting in a stationary position onto the deck, said circular rack being positioned circumferentially around said rotatable base in a horizontal plane adjacent the horizontal plane of said rotatable base;

rotation means mounted with said rotatable base for engaging said circular rack for rotating said circular base; and said rotatable base and said stationary rack being mounted for rotation with respect to each other by a bearing assembly mounted therebetween, said bearing assembly including an inner and outer race with ball bearings therebetween, said circular rack operating as said outer race and said inner race being affixed to said rotatable base.

2. The structure set forth in claim 1, wherein said winch assembly includes:

a drum mounted for rotation between said two opposing frame members, said drum having positioned therein a shaft; and a gear drive assembly mounted onto said opposing side frame members in operative engagement with said drum shaft and said drum for controlling the rotation of said drum.

3. The structure set forth in claim 1, including:

said rotating means including a motor mounted on said rotatable base and having mounted therewith a drive pinion, said drive pinion engaging said circular rack for rotating said rotatable base, pedestal and boom assembly with respect to the deck of the vessel.

4. The structure set forth in claim 1, including:

said rotating drum being formed of a hollow cylindrical drum portion and opposing hubs; and said hubs having central openings therein which receive a drum shaft, which drum shaft extends through said hubs and through said opposing frame members.

5. The structure set forth in claim 4, including:

said opposing frame members including annular mounting rims;

said hubs of said rotating drum including annular mounting rims positioned concentrically within said opposing frame members rims; and bearing means mounting said hubs for rotation with respect to said opposing frame members.

* * * * *